US005393292A

United States Patent [19]

Sand

[11] Patent Number: 5,393,292

[45] Date of Patent: Feb. 28, 1995

[54] PAPER CUP HANDLE ATTACHMENT ASSEMBLY

[75] Inventor: Dale L. Sand, Hubertus, Wis.

[73] Assignee: Paper Machinery Corporation, Milwaukee, Wis.

[21] Appl. No.: 241,504

[22] Filed: May 12, 1994

Related U.S. Application Data

[63] Continuation-in-part of Ser. No. 110,557, Aug. 23, 1993.

[51] Int. Cl.[6] ..... B31B 1/34; B31B 1/62; B31B 1/86

[52] U.S. Cl. ..... 493/76; 493/88; 493/114; 493/152; 493/155; 493/471; 493/466; 493/296; 156/521; 269/48.1

[58] Field of Search ..... 220/710.5; 229/1.5 B; 493/67, 76, 88, 114, 120, 909, 154, 155, 156, 152, 468, 471, 465, 466, 296, 269; 29/792; 156/223, 224, 261, 518, 521, 579; 413/72, 74; 269/48.1

[56] References Cited

U.S. PATENT DOCUMENTS

| | | | |
|---|---|---|---|
| 2,203,515 | 6/1940 | Barbieri | 493/155 |
| 2,315,535 | 4/1943 | McCann | 413/72 |
| 2,863,367 | 12/1958 | Thiem | 493/155 |

*Primary Examiner*—Jack W. Lavinder
*Attorney, Agent, or Firm*—Foley & Lardner

[57] ABSTRACT

A machine for securing a thermoplastic coated paper handle to a paper cup having a seam on one side of the cup, the machine including a die assembly for forming paper handles having a backing strip and a wing on each side of the strip, a mandrel turret having a number of mandrels spaced about the perimeter of the turret, each of said mandrels having a blade assembly projecting outwardly from the surface of the mandrel to engage the seam in the cup, and a wheel assembly for rotating the cups on the mandrel to move the seam in the cup into engagement with the blade assembly, and a transfer turret for transferring the paper handles from the die assembly to the mandrel turret for attachment to the cups.

5 Claims, 7 Drawing Sheets

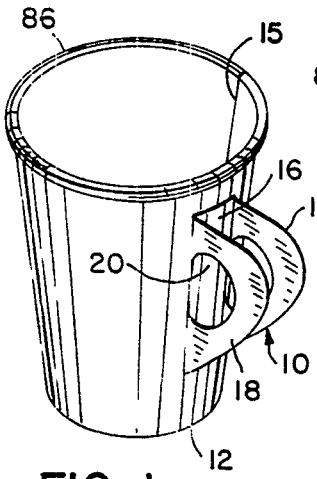
FIG. 1
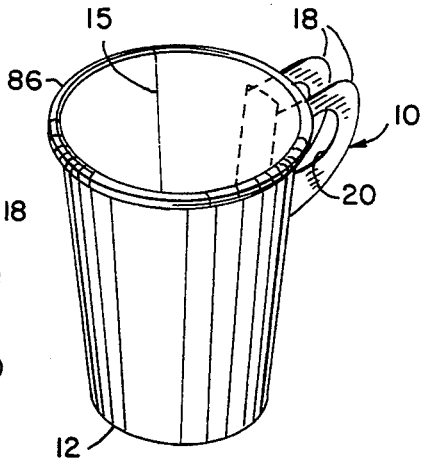
FIG. 2
FIG. 3
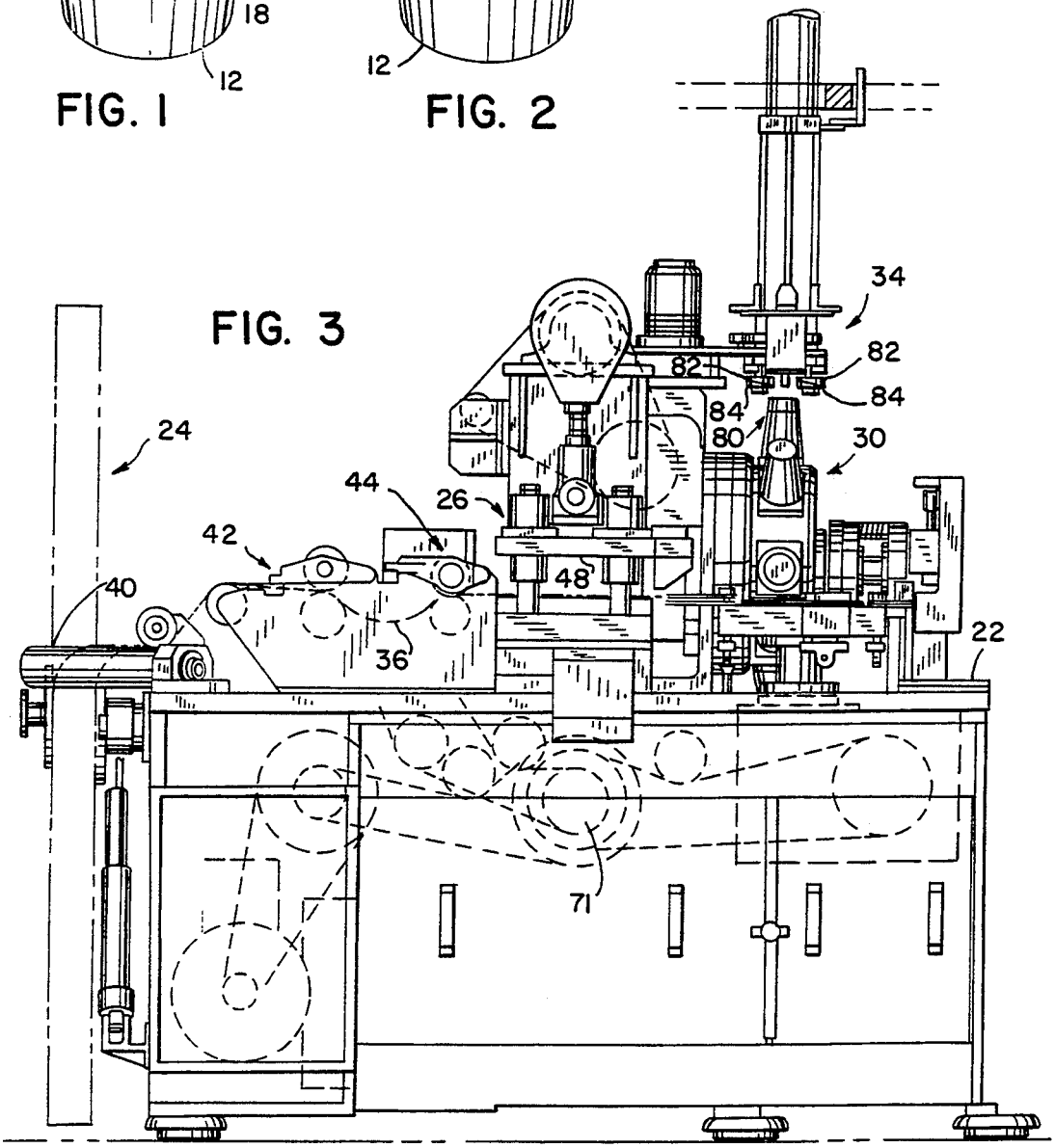

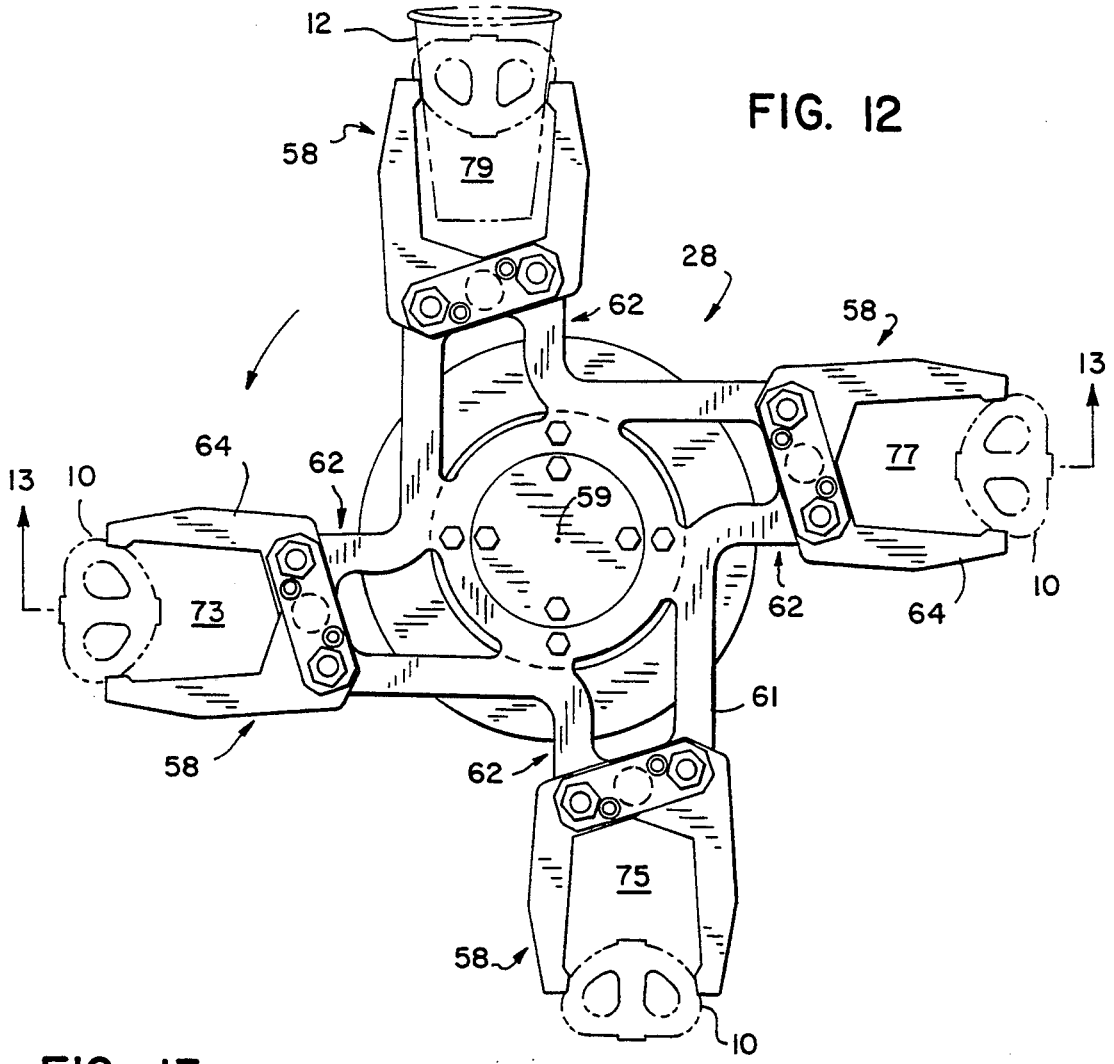
FIG. 12
FIG. 13
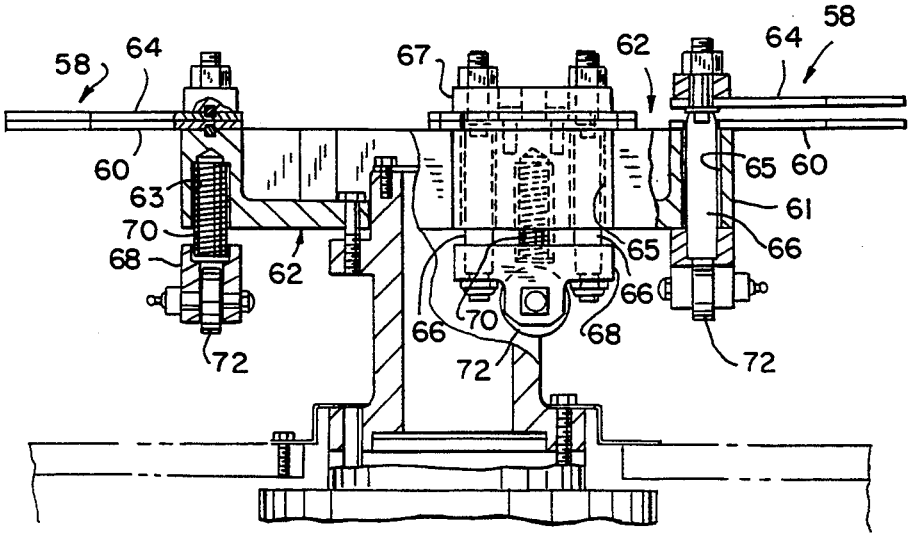

PAPER CUP HANDLE ATTACHMENT ASSEMBLY

RELATED APPLICATION

This application is a continuation-in-part of U.S. Ser. No. 08/110,557, filed Aug. 23, 1993, still pending, entitled: "Paper Cup Handle Attachment Assembly."

FIELD OF THE INVENTION

The present invention relates to securing of a butterfly type handle to a paper cup and more particularly to a machine for cutting, heating and applying a thermoplastic coated handle to a paper cup.

BACKGROUND OF THE INVENTION

Cup making machines of the type contemplated herein generally feed a strip of paper (thermoplastic coated if using forced hot air) through a die by using a pair of feed rollers connected to a one way clutch. A follower arm was connected to the clutch on one end and to a coupler link on the other to oscillate the arm causing the feed rolls to roll intermittently in one direction. In this arrangement, difficulty was encountered in the adjustment of the paper feed length.

The paper strip is stepped through a die to progressively form the handle. This is involved in seven steps. A pair of transfer fingers were used to support the wings for cut off and transfer the handle horizontally underneath a mandrel on the mandrel turret. A clamp on the turret swings up to clamp the handle to the cup on the mandrel. Since the transfer fingers only support the handle wings, the handles were not properly aligned on the cup.

There are twelve stations on the mandrel turret. Cups are stored in a vertical reservoir above the mandrel turret. Cups are fed onto the mandrel turret by means of an escapement device which picks off one cup at a time and pulls it down on to the mandrel. Between the second and fourth stations the cups are rotated on the mandrels by rubbing against a stationary rubber hose as the cups are indexed by. The cups are free to rotate until the inside seam of the cup hits a blade protruding from the mandrel surface. The blade stops the cups from rotating any further. The cups then slide along the hose up until the fourth station. At the fourth station the handles are clamped to the cup by a pivoting clamp arm. The arm is activated by an oscillating plate cam. Heaters in the clamp cure the glue as it indexes around to the twelfth station. In the case of heat sealing, no heat is applied and the seal is allowed to cool. At the twelfth station the cups are picked off the mandrel by a pair of fingers that pull the cups up into a nesting area. The stacks of cups are then removed from the nesting area by hand.

SUMMARY OF THE PRESENT INVENTION

In accordance with the preferred implementation of the present invention a machine is provided for automatically cutting, heating and securing a butterfly type paper handle to the side wall of a paper cup. The machine contemplates the feeding of a thermoplastic coated strip of paper to a die assembly in timed relation to the movement of a transfer turret and a mandrel turret. The butterfly type paper handle includes a backing strip having foldable wings on each side of the backing strip and an elliptical type finger hole in each wing. The paper strip is fed through a die set for stamping the handle in the strip. The handle is fed into the transfer turret and suspended between the fingers of one of the gripper assemblies. In this regard, the outer edges of wings are grasped by the fingers with the backing strip located intermediate the fingers. The transfer turret is stepped to a confirmation station to verify the presence of the handle, then to a heat station to activate the heat sensitive thermoplastic coating and then into the path of motion of the mandrels on mandrel turret to adhesively affix the handle to the side of a paper cup mounted on the mandrel.

The mandrel turret is stepped through eight stations. A paper cup is fed from a cup reservoir onto one of the mandrels at the first station. A vacuum is drawn through the mandrel to seat the cup on the mandrel. The mandrel is moved to a verification station to verify the presence of a cup on the mandrel. The mandrel turret is stepped to the handle mounting station. A vacuum is drawn through the mandrel to seat the cup on the mandrel as the mandrel moves into alignment with the gripper assembly holding the handle. A primary clamp is activated to seat the end of the backing strip on the handle on the cup. The handle is then released from the gripper assembly. A secondary clamp is activated to move into engagement with the rest of the backing strip as the mandrel moves through the gripper assembly to the first of three cooling stations. The mandrel is then stepped to the discharge station. The primary and secondary clamps are released from the backing strip and the cup is discharged by air pressure passed through the mandrel. The mandrel is then stepped to a delay station prior to repeating the cycle.

In accordance with another aspect of the invention the cup is preferably rotated on the mandrel to prevent the seam in the cup from stopping in alignment with the area of the cup where the handle is to be mounted. This is achieved by providing a bar in the side of the mandrel remote from the area where the handle is to be mounted on the cup and a rotatable head on the end of the mandrel. The cup is rotated on the mandrel as the mandrel turret is stepped to each station. The cup will stop rotating when the seam engages the bar thus preventing the seam from stopping in the location of the handle.

Other principal features and advantages of the invention will become apparent to those skilled in the art upon review of the following drawings, the detailed description and the appended claims.

BRIEF DESCRIPTION OF THE DRAWINGS

FIG. 1 is a perspective view of a paper cup with butterfly handle attached;

FIG. 2 is a perspective view of the paper cup showing the seam;

FIG. 3 is a front elevation view of the paper handle attaching machine;

FIG. 12 is a top view of the transfer turret;

FIG. 13 is a view taken on line 13—13 of FIG. 12;

Figure 9:
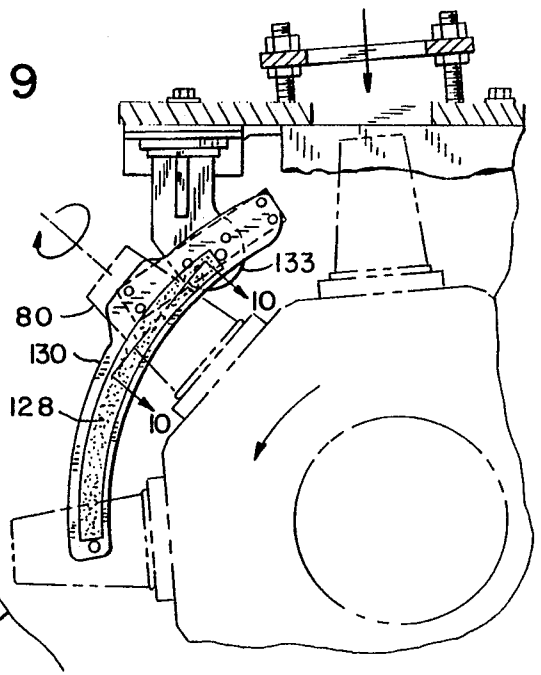
FIG. 9 is a partial view of the mandrel turret showing the cup rotation actuator.

Before explaining at least one embodiment of the invention in detail it is to be understood that the invention is not limited in its application to the details of construction and the arrangement of the components set forth in the following description or illustrated in the drawings. The invention is capable of other embodiments or being practiced or carried out in various ways. Also, it is to be understood that the phraseology and terminology employed herein is for the purpose of description and should not be regarded as limiting.

DETAILED DESCRIPTION OF THE PREFERRED EMBODIMENTS

An apparatus according to the present invention generally relates to the attachment of a butterfly type paper handle 10 to the side of a paper cup 12 as shown in FIGS. 1 and 2. A seam 15 is typically located on the inside of the cup. The cup as shown is tapered however the butterfly type handle could also be applied to a cylindrical cup. The handles 10 are formed from a thermoplastic coated paper strip 14 and generally includes a backing strip 16 having a wing 18 attached to each side of the backing strip 16. An opening 20 is generally provided in each wing 18.

The exemplary machine generally includes a frame or housing 22 for supporting a punch die assembly 26, a transfer turret 28 and a mandrel turret 30. The paper strip 14 is supported on a roll stand 24 mounted on one side of the frame. The paper strip is fed to the die assembly 26 by a drive assembly 32. The paper strip is punched in the die assembly 26 to form a strip of butterfly handles 10, FIG. 11B. The handles 10 are fed into the transfer turret 28, heated and aligned with the mandrel turret 30. Paper cups 12 are simultaneously fed from a storage rack 34 to the mandrels on the mandrel turret 30. A handle 10 is affixed to each cup 12 on the mandrel turret and the cup with handle attached is discharged from the mandrel turret 30 into a discharge tube 31.

Paper Drive Assembly

The paper strip drive assembly 32 generally includes a pair of idler rollers 38, a 45° roller 40 which turns the paper strip 90° into a drive roll assembly 42. The paper strip 14 is then passed through a metering roll assembly 44 into the punch die assembly 26. The drive roll assembly 42 continuously drives the paper strip 14 into the metering roll assembly 44 which is actuated in timed relation to the operation of the punch die assembly 26. In this regard, a take up loop 36 will form in the paper strip 14 between the drive roll assembly 42 and the metering roll assembly 44. The metering roll assembly 44 is actuated to advance the paper strip 14 in a step-by-step manner in timed sequence to the operation of the die assembly 26. The metering roll assembly 44 will accelerate the movement of the strip 14 in order to take up the loop 36 in the strip 14 between the drive roll assembly and the metering roll assembly.

Punch Die Assembly

Figure 5:
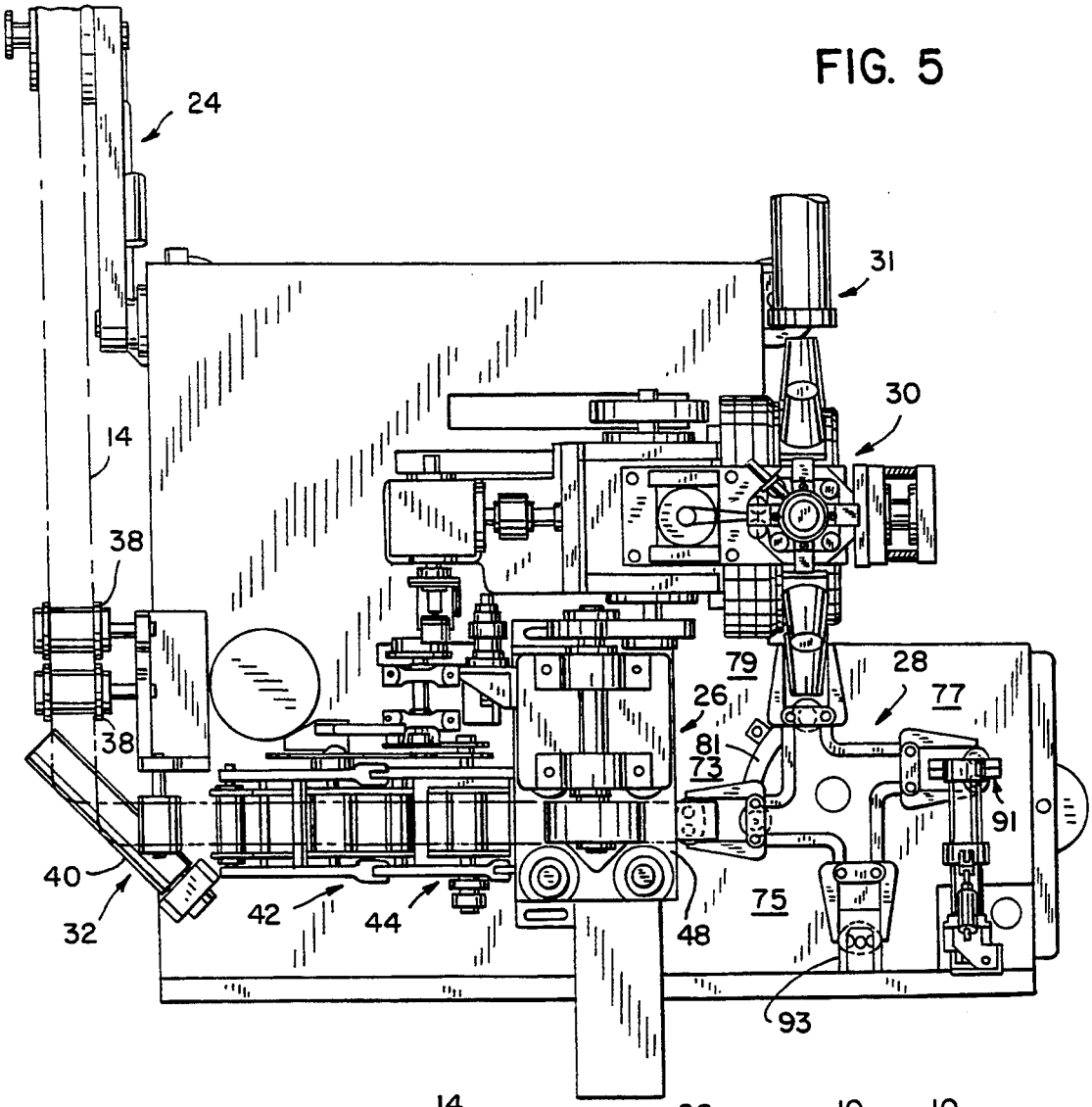
FIG. 5 is a top view of the handle attaching machine showing the transfer turret.
Figure 11:
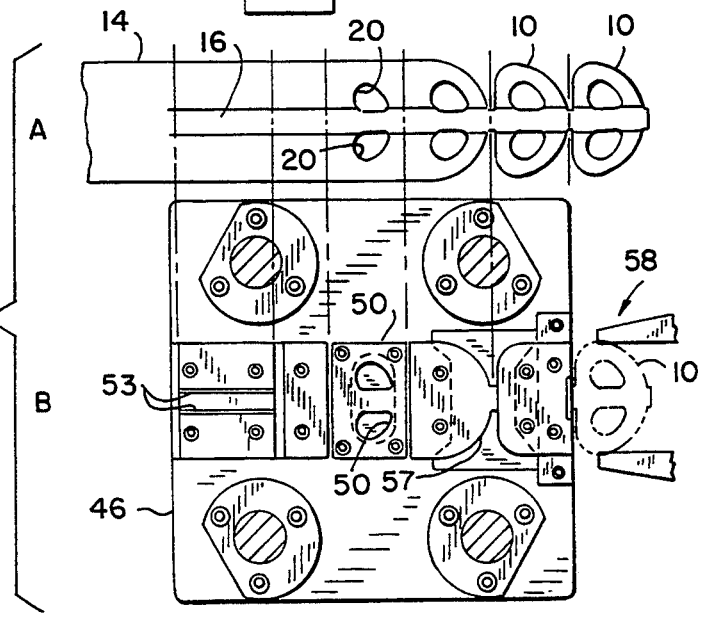
FIG. 11A is a top view of the die assembly.
FIG. 11B is a representative view of the steps for forming the butterfly handle.

The punch die assembly 26 includes a fixed die plate 46, FIG. 11A, and a punch plate 48, FIG. 5. The die plate 46 includes a pair of openings 50, a pair of generally "V" shaped cutting edges 52 and a pair of scoring dies 53. The punch plate 48 includes a pair of punches 51 corresponding to openings 50 and "V" shaped cutting edges (not shown) corresponding to cutting edges 52.

As shown in FIGS. 11A and 11B, a butterfly type handle 10 is formed in four steps in passing the strip through the die plate assembly. In the first step, the strip 14 is scored by die 53 to form the backing strip 16. In the second step openings 20 are punched in the wings 18 of the handles 10 through the openings 50 in the fixed plate 46 by punches 51 in the punch plate. In the third step, the wings 18 are formed by the cutting edges 52 on the die plate 46 and the edges on the punch plate 48 leaving a butterfly shaped handle 10 connected to the end of the strip 16. The butterfly shaped handle 10 on the end of the paper strip 14 is then advanced into the path of motion of the transfer turret 28. In the fourth step the back edge of the backing strip 16 of the handle is cut by the punch plate 48.

Transfer Turret

The transfer turret 28 as shown in FIGS. 12 and 13 includes a base plate 61 having four arms 62, each arm supporting a gripper plate assembly 58. It should be noted that each gripper plate assembly 58 is offset from the axis 59 of the turret 28. Each gripper plate assembly 58 includes a U-shaped bottom plate 60 mounted on the end of each arm 62 and lying in a common plane. An identical U-shaped upper gripper plate 64 is supported above each gripper plate 60 on a pair of shafts 66 which pass through openings 65 in the end of each arm 62. The shafts 66 are connected to a cross piece 68 beneath the arm 62 and a cross piece 67 above the gripper plate 64. Springs 70 are positioned in blind bores 63 in the end of arm 62 and bear against a cross piece 68 to bias the plates 60 and 64 to a closed position. A roller 72 is mounted on the bottom of each cross piece 68 which is pushed up by an eccentric cam assembly 69 mounted on drive shaft 71 to move the upper gripper plate 64 between open and closed positions at the pick up station 73 and at the mandrel station 79. In this regard and referring to FIG. 4 the eccentric cam assembly 69 generally includes an eccentric cam 81 mounted on a drive shaft 71 and a plunger 83 mounted on the frame 22 which is aligned with the roller 72. The upper end 85 of plunger 83 is positioned to engage the roller 72. A cam follower 87 is provided on the lower end of plunger 83 in a position to ride on the surface of the cam 81. The cam follower 87 is biased by a spring 89 into engagement with the eccentric cam 81.

The butterfly handle 10 is fed into the space between the U-shaped grippers which are then closed by the rotation of the eccentric cam 81. The tips of the wings 18 of the butterfly handles 10 are caught between the fingers of the gripper plate assemblies 58. The transfer turret 28 is stepped 90° to rotate the butterfly handle 10 to a checking station 75. An optical sensor 93 is used to verify the presence of a handle 10 in the gripper assembly. If no handle appears the apparatus is stopped. If present the turret is stepped another 90° to a heat station 77 where the backing strip 16 is heated by means of an electric hot air heater 91 to activate the thermoplastic adhesive coating on the paper handle 10. The transfer turret is then stepped to the mandrel station 79 to align the handle 10 with the mandrel turret 30.

A ramp 95 is provided between the mandrel station 79 and the pick up station 73 as shown in FIG. 5. The cam roller 72 will ride up the ramp 95 onto an eccentric cam assembly 69 provided at the pick up station 73 so that the gripper plate assembly 58 is open to receive the next handle 10.

Mandrel Turret Assembly

Figure 4:
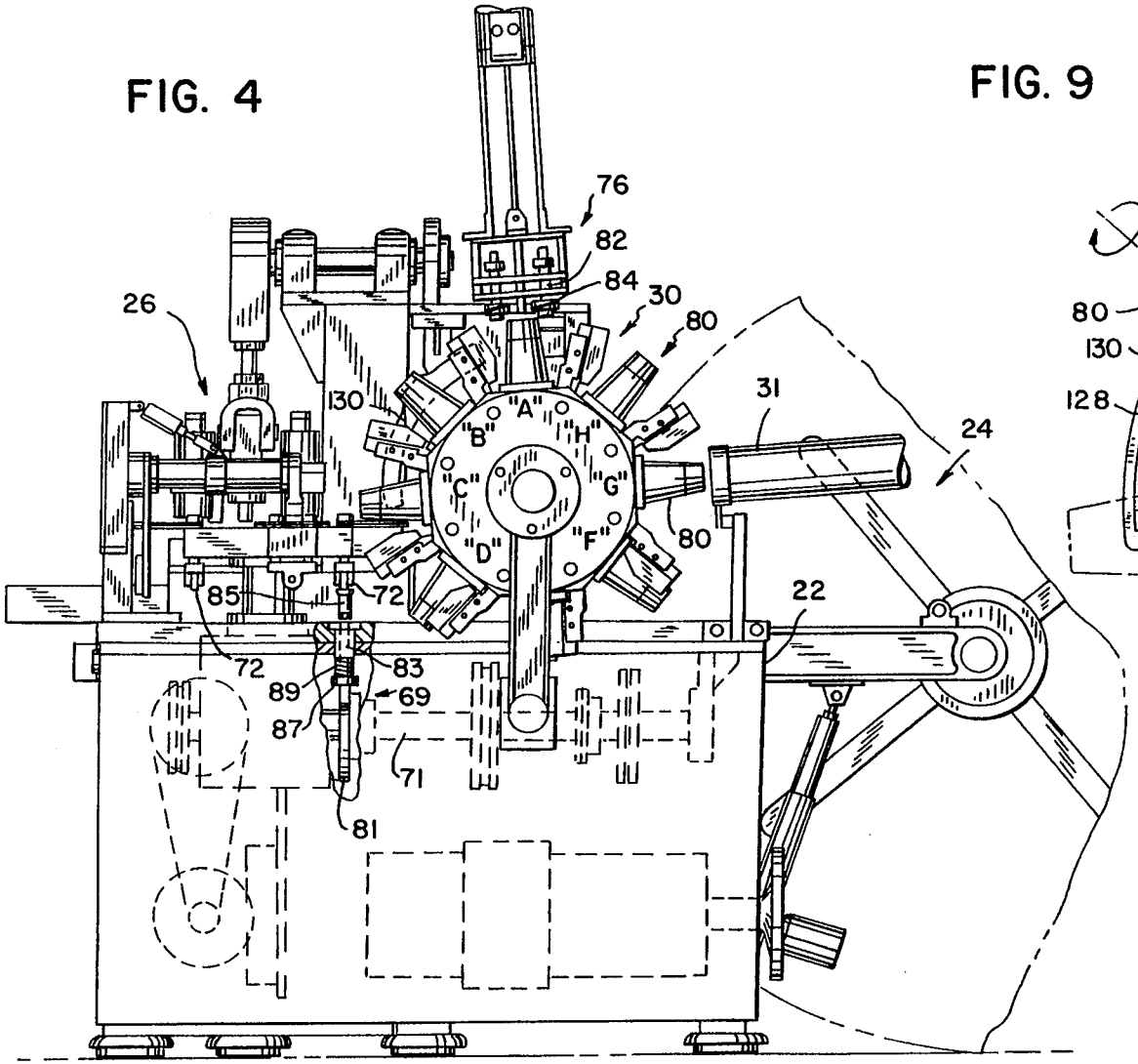
FIG. 4 is a side elevation view of the machine showing mandrel turret.

More particularly, and referring to FIGS. 3 and 4, the paper cups are stored in a cup reservoir 76 which is aligned with a mandrel 80 on the top of the mandrel turret 30. A set of four drive wheels 82 (only two are shown) are provided at the bottom of the reservoir 76 each of which includes a screw thread recess 84 to engage the lip 86 on the open end of the cup 12 in the reservoir 76. The drive wheels 82 are rotated to release one cup 12 at a time from the reservoir so that it drops onto the top mandrel 80 at the first or load station "A."

The mandrel turret 30 includes eight tapered mandrels 80 each having a shape corresponding to the shape of the paper cups 12. The mandrels 80 are equally spaced about the perimeter of the turret 30 and are aligned to pass through the gap between the fingers 78 in the U-shaped gripper assemblies 58. The mandrels are rotated through eight stations noted "A," "B," "C," "D," "E," "F," "G," and "H."

Figure 6:
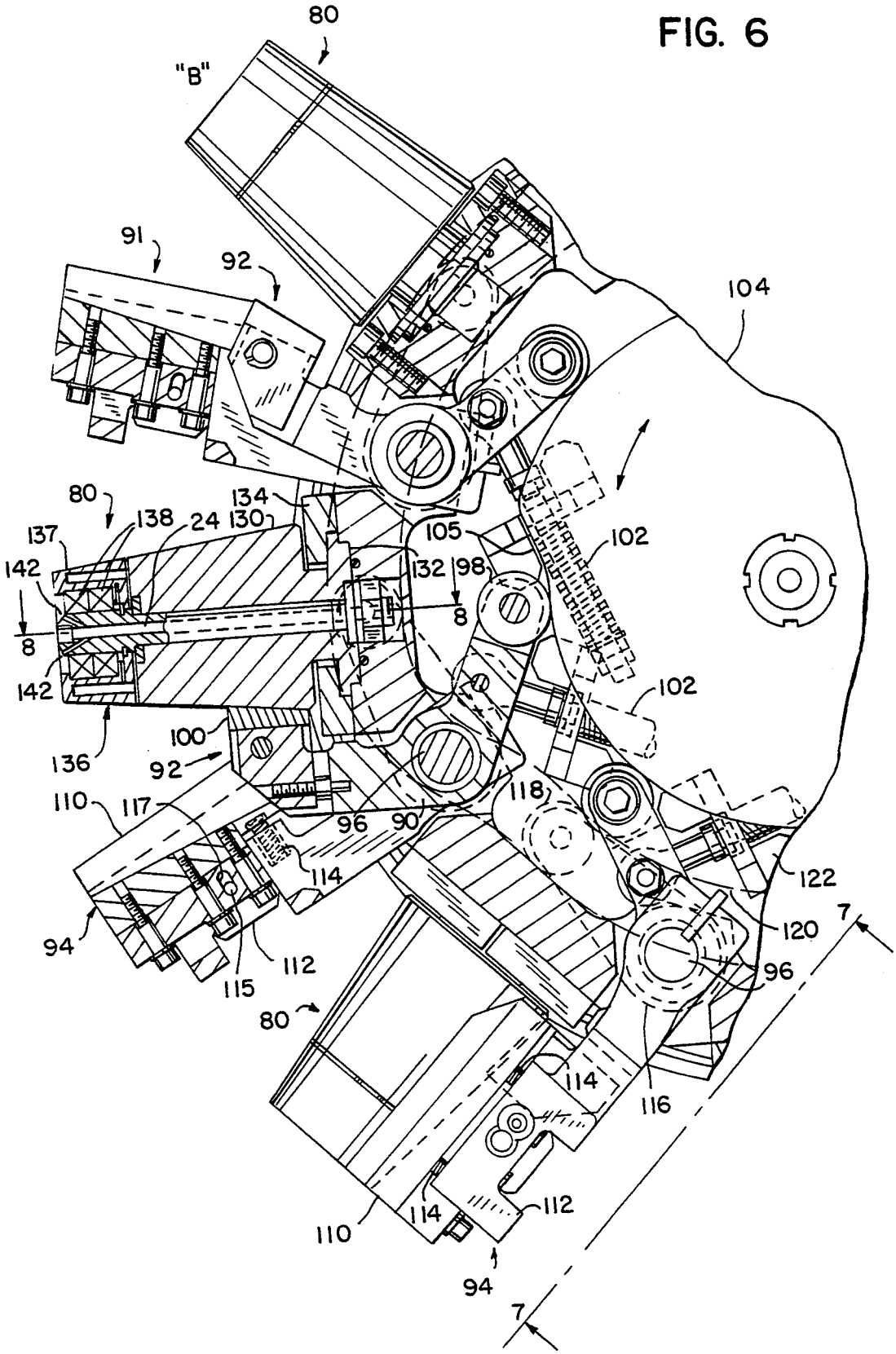
FIG. 6 is a partial view of the mandrel turret showing the cam arrangement for the primary and secondary clamps.
Figure 8:
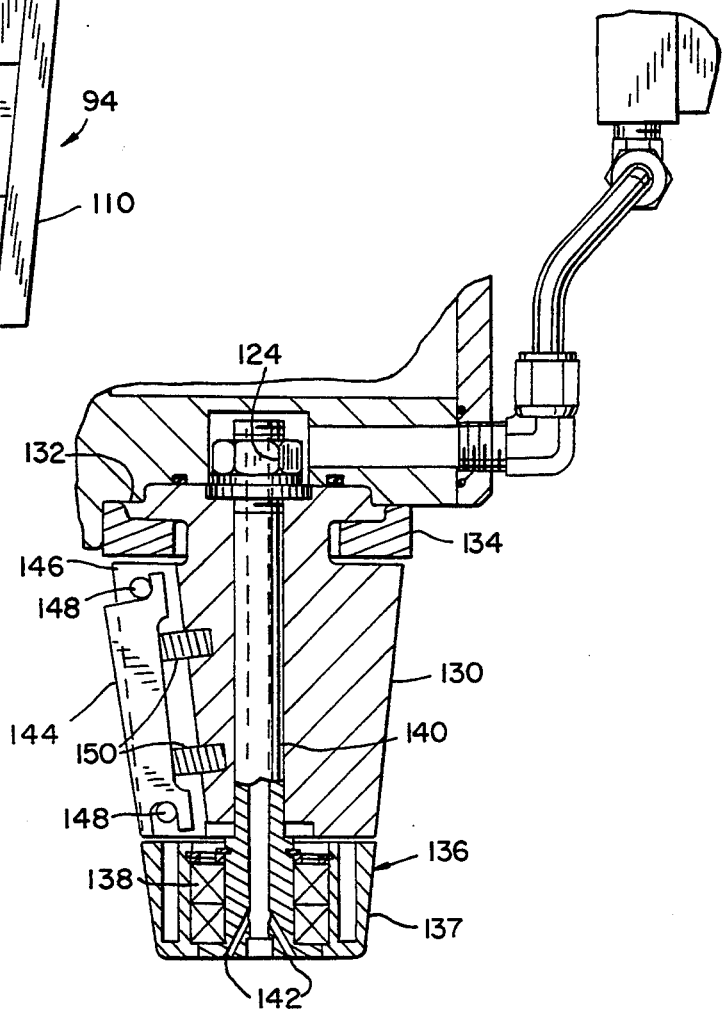
FIG. 8 is a view taken on line 8—8 of FIG. 6.

Referring to FIGS. 6 and 8 each mandrel 80 generally includes a tapered head 130 having a flange 132 on the inner end. The mandrel is mounted on the turret by means of a clamp plate 134 which engages the flange 132 on the inner end of the mandrel. A rotating head assembly 136 is mounted on the outer end of the mandrel head 130. In this regard, the rotating head assembly 136 includes a tapered ring 137 mounted on a pair of roller assemblies 138. The roller assemblies 138 are mounted on a hollow tubular support 140 having a number of air passages 142 at the outer end which can be connected to a vacuum source or to an air pressure source through a central passage 124 as described hereinafter. A blade 144 is mounted in a slot 146 in one side of the mandrel and retained therein by pins 148. The blade 144 is biased outwardly by springs 150.

The turret 30 is stepped in sequence with the movement of the transfer turret 28 for attachment of a handle 10 to a cup 12. The mandrel turret 30 is stepped to eight stations to complete the attachment of the handle 10 to the cup. (Of course were a different process used which required more or fewer than eight stations, those skilled in the art would readily be able to adapt the disclosed structure as necessary given the present disclosure.) At the top or first station "A" as noted above a cup 12 is mounted on the mandrel 80. The mandrel turret 30 is stepped to advance the mandrel one step to a verification station "B." A fiber-optic sensor (not shown) is located at the end of the mandrel to sense the presence of a cup on the mandrel. The mandrel turret is then stepped to an attachment station "C." The transfer turret 28 is indexed to align a butterfly handle 10 in the path of motion of one of the mandrels on the turret. At the same time a primary clamp assembly 92 is pivoted into engagement with a portion of the backing strip 16 to hold the handle 10 against the side of the cup 12 as the handle is released from the gripper assembly 58. The mandrel then passes through the gap between the fingers 78 in the gripper assembly 58. As the mandrel moves through the gripper assembly a secondary clamp assembly 94 is pivoted toward the mandrel to seat the remainder of the backing strip 16 against the paper cup on the mandrel as the mandrel moves to the first cooling station "D." The handle 10 remains clamped against the cup through the next two stations "E" and "F" to allow the thermoplastic adhesive coating to cool. The mandrel is then moved to the discharge station "G." The primary and secondary clamps 92 and 94 are released and the cup is blown off the end of the mandrel into a discharge chute 31. The mandrel turret is stepped one more time to a delay station "H" before repeating the sequence.

Figure 7:
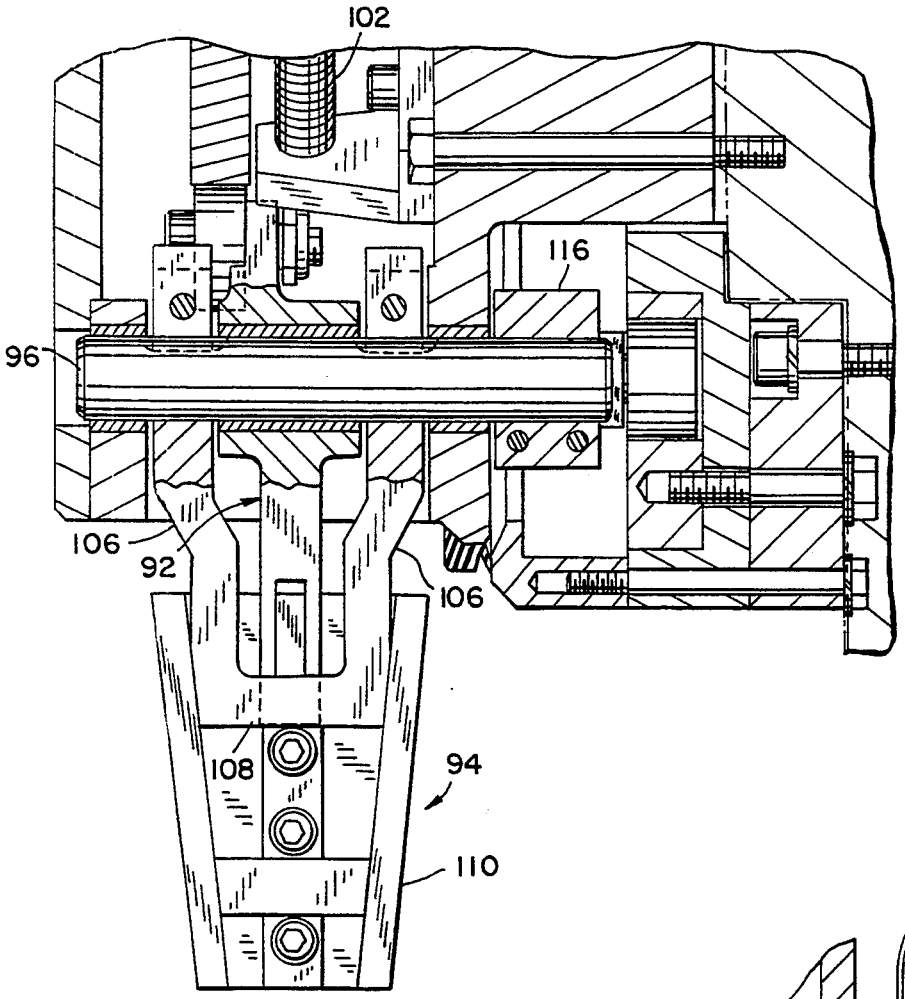
FIG. 7 is a view taken on line 7—7 of FIG. 6.

The operating assembly for the primary and secondary clamp assemblies 92 and 94 are shown in FIGS. 6 and 7. In this regard the primary clamp assembly 92 is in the form of a bell crank 90 which is pivotally mounted on shaft 96 and includes a cam roller 98 on one end and a clamp plate 100 on the other end. The clamp plate 100 is biased into engagement with the mandrel by means of a compression spring assembly 102. The cam roller 98 is positioned to engage the edge of a cam plate 104 having a cam surface 105 located inwardly of mandrel station "C." The cam plate 104 is oscillated through approximately 20° in timed relation to the engagement of a mandrel 80 with a handle 10 suspended between the fingers of one of the gripper assemblies 58. The cam plate 104 is shown with the clamp assembly 92 in the open position at station "B." The cam plate 104 is rotated counterclockwise as a gripper assembly 58 moves into alignment with the mandrel 80 at station "C." The roller 98 will follow the cam surface 105 allowing the clamp plate 100 to move into engagement with the end of the backing strip 16 on the handle 10 to clamp the handle to the mandrel. If properly adjusted the cam roller 98 will just barely touch the cam plate surface so that the full force of the spring assembly 112 will be applied to the clamp.

The secondary clamp 94 includes a pair of arms 106 having one end mounted on shaft 96 and the other end connected by a cross piece 108. A clamp plate 110 is mounted on a block 112 and is supported thereon by a pin 115 which is free to move within the limits of slot 117. The secondary clamp plate 110 is biased by springs 114 into engagement with the mandrel to hold the backing strip of the handle against the mandrel. An arm 116 is mounted on the end of shaft 96 for supporting a cam roller 118 in a cam track 120 in a plate 122 in the side wall of the mandrel turret. When the mandrel is rotated counterclockwise the cam roller 118 will follow the surface of the track 120 pivoting the shaft 96 to move the secondary clamp 94 into engagement with the rest of the backing strip 16 to firmly secure the handle 10 to the cup. The cam plate 104 and cam track 120 include a cam surface for releasing the primary and secondary clamps prior to rotation of the mandrels to the discharge station.

Figure 10:
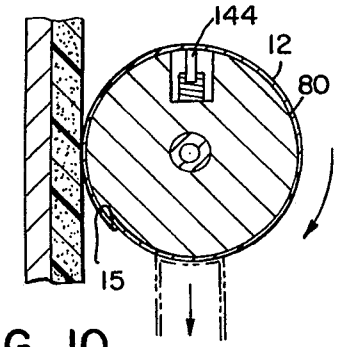
FIG. 10 is a view taken on line 10—10 of FIG. 9.

Means are provided for positively locating the seam 15 on the inside of the cup so that the seam 15 will not be aligned with the backing strip 16 of the butterfly handle. In this regard the blade 144 is located in a position to engage the edge 15 of the seam on the inside of the cup. As shown in FIGS. 9 and 10 a urethane strip 128 is secured to a track 130 which is mounted on a support 132 in the frame 22. The urethane strip 128 is positioned to engage the side of the cup so that the cup and rotary head assembly 136 will rotate until the seam 15 inside of the cup engages the blade 144 on the side of the mandrel. Once the seam hits the blade the cup will stop and the urethane strip 128 will slide on the surface of the cup.

Figure 14:
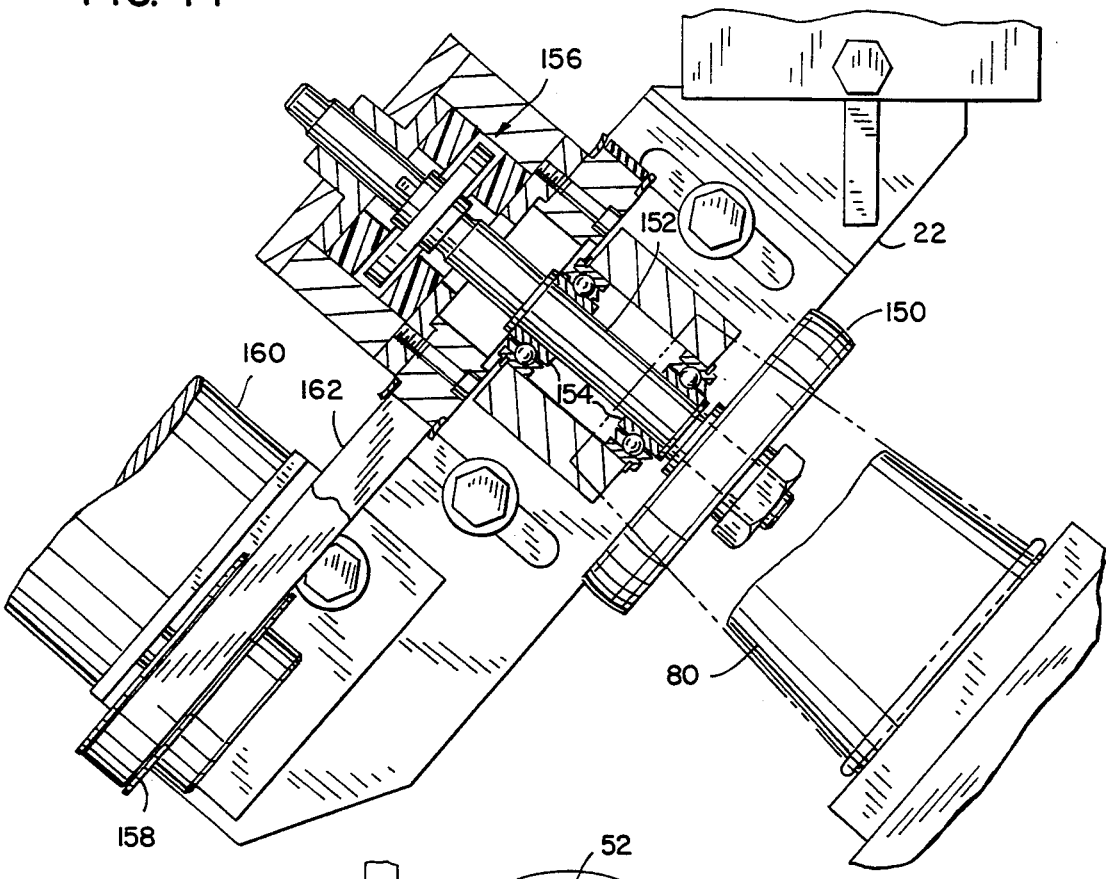
FIG. 14 is a side view of the cup rotating assembly partly broken away to show the drive mechanism.
Figure 15:
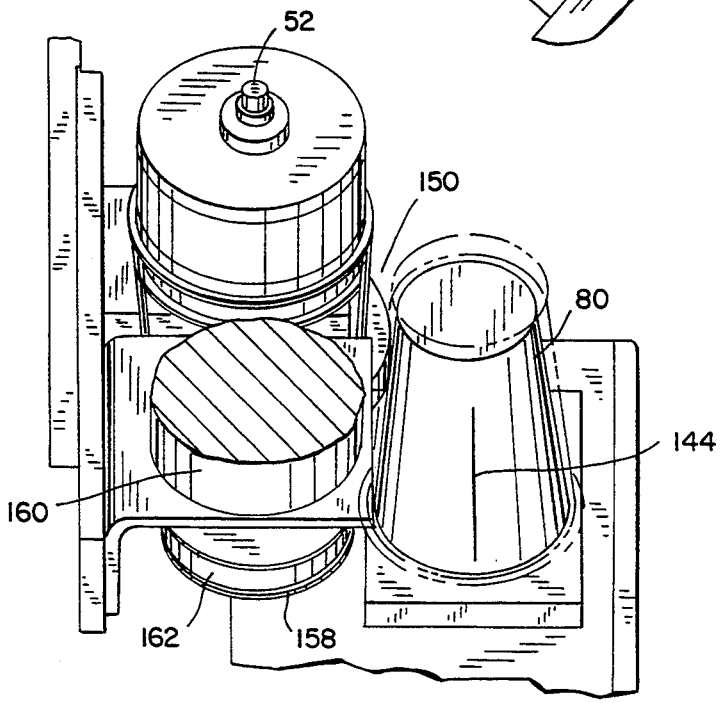
FIG. 15 is an end view of the cup rotating assembly.

An alternate arrangement for positively aligning the seam 15 of the cup on the mandrel 80 is shown in FIGS. 14 and 15 wherein a wheel 150 is shown mounted on one end of a shaft 152. The shaft 152 is supported for rotary motion in a set of ball bearings 154 mounted on the frame 22. A magnetic clutch 156 is mounted on the other end of the shaft 152. The magnetic clutch 152 is driven by a drive motor 160 having a pulley 158 which is connected to the magnetic clutch 156 by means of a belt 162. The drive motor 160 operates continuously to drive the magnetic clutch 156. The driving force of the clutch 156 is adjusted to maintain sufficient force to rotate the cup and rotary head 136 on the mandrel 80. The cup will stop when the seam 15 of the cup engages the blade 144 as described above.

Thus, it should be apparent that there has been provided in accordance with the present invention a paper cup handle attachment assembly that fully satisfies the objectives and advantages set forth above. Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

The embodiments of the invention in which an exclusive property or privilege is claimed are defined as follows:

1. A machine for securing a thermoplastic coated butterfly type paper handle onto a paper cup having a seam in the side of the cup, said machine comprising:

a die assembly for forming a paper handle having a backing strip and a wing on each side of said strip, a mandrel turret having a number of mandrels spaced about the perimeter of the turret, each of said mandrels having a blade assembly projecting outwardly from the surface of the mandrel to engage the seam in the cup, a cup dispenser for mounting cups on said mandrels, a wheel assembly for rotating said cup on said mandrel to move the seam on the side of the cup into engagement with the blade assembly, and a transfer turret for transferring said handles from said die assembly to said mandrel turret for mounting the handles on said paper cups.

2. The machine according to claim 1 wherein said wheel assembly includes a shaft mounted for rotary motion on the machine, a wheel mounted on said shaft in a position to engage the side wall of the cup, a magnetic clutch operatively connected to said shaft and a drive motor operatively connected to said clutch for rotating said shaft whereby the seam of the cup is rotated into engagement with the blade assembly.

3. The machine according to claim 2 wherein said mandrel includes a rotating head for supporting the cup on the mandrel.

4. An assembly for rotating the seam in the side of a paper cup into engagement with a blade in the side of a mandrel, said assembly comprising:

a shaft mounted in close proximity to the mandrel, a wheel mounted on one end of the shaft for rotating the cup on the mandrel, a magnetic clutch mounted on the other end of the shaft, and a drive motor operatively connected to continuously drive the clutch whereby said wheel will stop rotating when the seam in the cup engages the blade in the mandrel.

5. The assembly according to claim 4 wherein said mandrel includes a rotating head at one end of the mandrel for supporting the cup on the mandrel.

* * * * *